US005977019A

United States Patent [19]

Ozeki et al.

[11] Patent Number: 5,977,019

[45] Date of Patent: Nov. 2, 1999

[54] MULTI-COLOR HEAT-SENSITIVE RECORDING MATERIAL AND THERMAL RECORDING METHOD

[75] Inventors: Keisuke Ozeki; Jun Naito; Yasuhiro Ogata, all of Shizuoka-ken, Japan

[73] Assignee: Fuji Photo Film Co., Ltd., Kanagawa, Japan

[21] Appl. No.: 08/796,136

[22] Filed: Feb. 6, 1997

[30] Foreign Application Priority Data

Feb. 6, 1996 [JP] Japan ..... 8-019836
Feb. 29, 1996 [JP] Japan ..... 8-043442

[51] Int. Cl.[6] ..... B41M 5/34

[52] U.S. Cl. ..... 503/204; 427/150; 427/152; 428/195; 428/484; 428/488.4; 428/513; 428/913; 428/914

[58] Field of Search ..... 428/195, 211, 428/513, 484, 488.1, 488.4, 913, 914; 503/204, 200, 226; 427/150–152

[56] References Cited

FOREIGN PATENT DOCUMENTS

| | | | |
|---|---|---|---|
| 49-12815 | 2/1974 | Japan | 503/200 |
| 49-114921 | 11/1974 | Japan | 503/200 |
| 55-5104 | 1/1980 | Japan | 503/200 |
| 56-4901 | 2/1981 | Japan | 503/200 |
| 61-118746 | 6/1986 | Japan | 503/200 |
| 2-230236 | 9/1990 | Japan | 503/200 |
| 3-91740 | 4/1991 | Japan | 503/200 |
| 1 563 591 | 3/1980 | United Kingdom | 503/200 |
| 1 563 592 | 3/1980 | United Kingdom | 503/200 |

*Primary Examiner*—Bruce H. Hess
*Attorney, Agent, or Firm*—Sughrue, Mion, Zinn, Macpeak & Seas, PLLC

[57] ABSTRACT

A multi-color heat-sensitive recording material including a support and two or more heat-sensitive recording layers formed on the support, wherein the support is a sheet-like substrate formed such that a resin layer is formed at least on the side of a base paper where the heat-sensitive recording layers are formed, and the surface of the sheet-like substrate on the side where the heat-sensitive recording layers are formed has a three-dimensional surface roughness of not more than 0.3 μm as measured at a filter wavelength of 0.8 to 2.5 mm before thermal recording is performed. The three-dimensional surface roughness of the sheet-like substrate is not more than 0.4 μm as measured at a filter wavelength of 0.8 to 2.5 mm after thermal recording is performed. The support is constructed of a sheet-like substrate having a resin layer on each of base paper. The rigidity of the sheet-like substrate as defined by JIS P8125 is 1.5 to 8.0 gf·cm, preferably 3.0 to 6.0 gf·m, as measured in a printing direction. Rigidity is adjusted by suitably selecting the thickness of the base paper, the basis weight, the kind of pulp, the thickness of the resin layer, etc.

17 Claims, 2 Drawing Sheets

MULTI-COLOR HEAT-SENSITIVE RECORDING MATERIAL AND THERMAL RECORDING METHOD

FIELD OF THE INVENTION

The present invention relates to a multi-color heat-sensitive recording material and to a thermal recording method using such a multi-color heat-sensitive recording material, and more specifically to a multi-color heat-sensitive recording material having excellent uniformity of picture quality and excellent feed performance and to a thermal recording method using such a multi-color heat-sensitive recording material.

BACKGROUND OF THE INVENTION

In image recording on a full-color heat-sensitive recording material, a thermal head directly contacts the surface of the recording material for thermal recording. Thus, if the surface of the recording material is rough, an uneven image quality will result. It is known that flatness of a recording material greatly depends on flatness of a support.

Conventionally, material used advantageously as a support is polyethylene-coated paper, which is manufactured by coating base paper from pulp with polyethylene kneaded with a white pigment or the like. However, use of polyethylene-coated paper as a support results in rough rippled gloss due to the rough base paper surface on which a polyethylene layer is formed, and thus uniformity of picture quality is considerably degraded.

In order to solve the above-described drawback, there have been proposed methods which do not use base paper as a support, but only use a thermoplastic resin film as a support. A polystyrene-based resin film which contains a white pigment as a filler is disclosed in Japanese Patent Application Laid-Open (JP-A) No. 49-114921 and Japanese Patent Application Publication (JP-B) No. 55-5104. According to UK Patent Nos. 1,563,591 and 1,563,592, barium sulfate is added to polyester, and the resultant mixture is spread. Japanese Patent Application Publication (JP-B) No. 56-4901 discloses a technique wherein barium sulfate and titanium dioxide are added to a thermoplastic resin. Japanese Patent Application Laid-Open (JP-A) No. 61-118746 discloses a technique wherein surface-treated titanium dioxide having an average grain size of 0.1 to 0.5 $\mu$m is added to polyester. These disclosed supports are hard and fragile, and thus are likely to generate crack when handled. Also, they give a stiff feel like plastic and a strange textural feel as compared with a support composed of base paper and a polyolefin resin layer melt-extruded on the base paper.

According to Japanese Patent Application Laid-Open (JP-A) No. 49-12815, a polyolefin layer which contains a white inorganic filler is formed on one side of synthetic paper or on one side of plastic film which enables writing thereon. However, after the thus-formed support is covered with a recording layer, the resultant recording material does not allow adjustment of a curl.

Also, Japanese Patent Application Laid-Open (JP-A) No. 3-91740 discloses a support wherein paper, synthetic paper, or a film substrate is coated with a polyolefin resin compound which contains a certain type of titanium dioxide. However, the thus-formed support fails to provide sufficient smoothness and readiness of handling.

Japanese Patent Application Laid-Open (JP-A) No. 2-230236 discloses a technique wherein a film of a thermoplastic resin such as a vinyl chloride resin, which is used as material for ID cards and cash cards because of good embossing property, is laminated with a polyolefin resin. However, the thus-formed support gives a stiff feel like a plastic sheet and a strange textural feel and fails to provide sufficient smoothness, as compared with a support composed of base paper and a polyolefin resin layer melt-extruded on the base paper.

SUMMARY OF THE INVENTION

A first object of the present invention is to provide a multi-color heat-sensitive recording material which provides excellent uniformity of picture quality while maintaining a textural feel of a conventional support which employs base paper.

A second object of the present invention is to provide a multi-color heat-sensitive recording material which solves the above-described drawbacks of a conventional support and provides excellent uniformity of picture quality and excellent feed performance while maintaining a textural feel of a conventional support which employs base paper.

A third object of the present invention is to provide a thermal recording method which provides excellent uniformity of picture quality and excellent feed performance.

To achieve the first object, the present invention provides a first multi-color heat-sensitive recording material comprising a support and two or more heat-sensitive recording layers formed on the support, wherein the support is a sheet-like substrate formed such that a resin layer is formed at least on the side of a base paper where the heat-sensitive recording layers are formed, and the surface of the sheet-like substrate on the side where the heat-sensitive recording layers are formed has a three-dimensional surface roughness of not more than 0.3 $\mu$m as measured at a filter wavelength of 0.8 to 2.5 mm before thermal recording is performed.

Preferably, the surface of the sheet-like substrate on the side where the heat-sensitive recording layers are formed has a three-dimensional surface roughness of not more than 0.4 $\mu$m as measured at a filter wavelength of 0.8 to 2.5 mm after thermal recording is performed.

Preferably, the sheet-like substrate is coated with a resin layer on both sides, and the resin layer is formed through melt extrusion. The resin layer is preferably made of an olefin-based resin, with polyethylene being of an olefin-based resin, with polyethylene being particularly preferable.

To achieve the second object, the present invention provides a second multi-color heat-sensitive recording material comprising a support and two or more heat-sensitive recording layers formed on the support, wherein the support is a sheet-like substrate formed such that a resin layer is formed on both sides of base paper, and rigidity of the sheet-like substrate as defined by JIS P8125 is 1.5 to 8.0 gf·cm as measured in a printing direction. The printing direction is a direction along which a heat-sensitive recording material is fed during printing. The above-described rigidity is preferably 3.0 to 6.0 gf·cm. The resin layer formed on both sides of base paper is preferably an olefin-based resin layer formed through melt extrusion coating or dry lamination.

To achieve the third object, the present invention provides a thermal recording method for a multi-color heat-sensitive recording material comprising a support and two or more heat-sensitive recording layers, wherein the support is a sheet-like substrate formed such that a resin layer is formed on both sides of base paper, and a printing direction is the one along which the sheet substrate has a rigidity of 1.5 to 8.0 gf·cm as measured in accordance with JIS P8125.

DETAILED DESCRIPTION OF THE INVENTION

Figure 1:
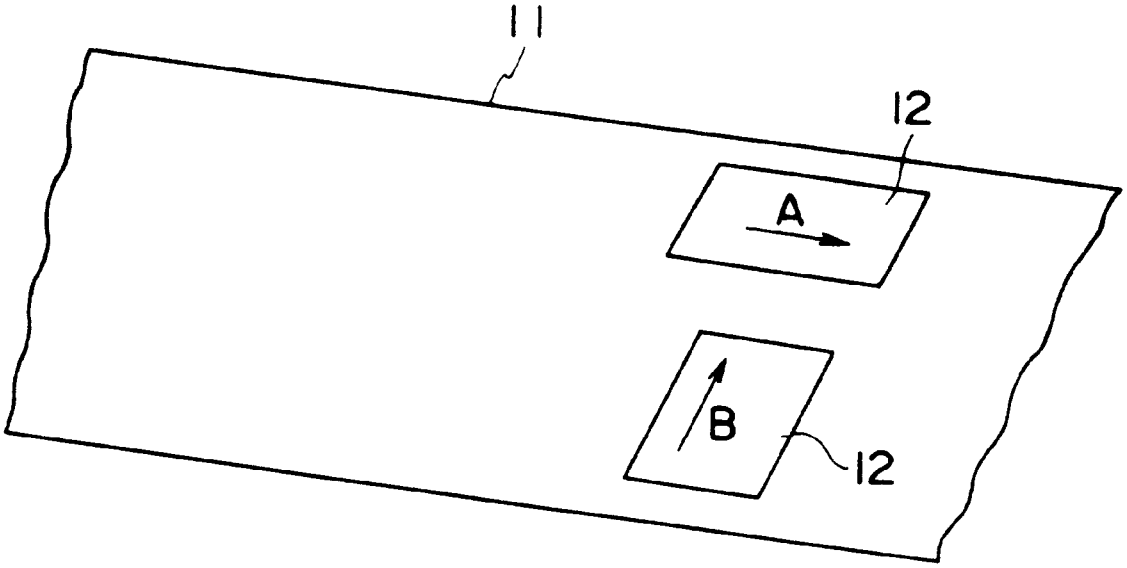
FIG. 1 is a view for illustrating rigidity of a sheet-like substrate according to the present invention.

The base paper which composes a support for a multi-color heat-sensitive recording material according to the present invention is selected from among those that are generally used in the art. That is, natural pulp from coniferous or broadleaf trees is used as a principal material, to which are added, as needed, fillers such as clay, talc, calcium carbonate, and urea resin particles; sizing agents such as rosin, alkyl ketene dimers, higher fatty acids, epoxy fatty acid amides, paraffin wax, and alkenyl succinic acid; paper strength reinforcing agents such as starch, polyamide polyamine epichlorohydrin, and polyacrylamide; and fixing agents such as alumina sulfate and cationic polymers. Particularly, base paper for use in the present invention is preferably softened through reduction of paper strength. To attain this softening effect, it is preferable to reduce the amount of paper force reinforcing agents and to add softening agents such as epoxy fatty acid amides and surfactants. Further, synthetic pulp may replace the above-described natural pulp. Alternatively, natural pulp and synthetic pulp may be mixed at a certain ratio.

The type and thickness of a base paper substrate is not particularly limited. The basis weight of a base paper substrate is preferably 60 g/m$^2$ to 170 g/m$^2$. Since as high flatness as possible is required of a multi-color heat-sensitive recording material, a base paper substrate preferably has an excellent smoothness and flatness of surface. To attain smoothness and flatness, a base paper substrate is preferably surface-treated with heat and pressure applied by a machine calender, a soft calender, or a super-calender. A support for a multi-color heat-sensitive recording material of the present invention is preferably formed such that base paper is coated with a surface sizing agent on both sides.

A surface sizing solution is an aqueous solution of polyvinyl alcohol or modified polyvinyl alcohol. To the surface sizing solution may be added polymers such as starch, carboxymethyl cellulose, hydroxyethyl cellulose, sodium alginate, cellulose sulfate, gelatin, and casein; metal salts such as calcium chloride, sodium chloride, and sodium sulfate; hygroscopic substances such as glycerin and polyethylene glycol; coloring and whitening substances such as dyes and fluorescent whitening agents; and pH controlling agents such as sodium hydroxide, aqueous ammonia, hydrochloric acid, sulfuric acid, and sodium carbonate. Also, softening agents such as epoxy fatty amides and surfactants may be added. Pigments may also be added as needed. Base paper may be impregnated or coated with a surface sizing solution through use of a size press, a tab size coater, or a gate roll coater.

Base paper used in the present invention has an internal coupling force of 0.5 to 2 kgf·cm as defined in TAPPI USEFUL METHOD 403, preferably 0.5 to 1.9 kgf·cm, more preferably 0.5 to 1.6 kgf·cm. When the internal coupling force of base paper is smaller than 0.5 kgf·cm, the strength of base paper reduces, paper making and processing is likely to become difficult, and feed performance on a printer deteriorates when a heat-sensitive recording material is color-generated. By contrast, when the internal coupling force of base paper exceeds 2 kgf·cm, the smoothness of base paper deteriorates, which in turn deteriorates the surface flatness of a resin layer formed on the base paper, which in turn deteriorates the surface smoothness of a heat-sensitive recording layer formed on the resin layer. This causes an uneven contact of a thermal head with the surface of the heat-sensitive recording layer, resulting in poor uniformity of picture quality. Also, an interior coupling force of base paper in excess of 2 kgf·cm causes a reduction in compressibility of base paper in a direction of thickness, which in turn causes a reduction in compressibility in a direction of thickness of a sheet-like substrate composed of the base paper and resin layers formed on both sides of the base paper, which in turn causes a reduction in compressibility in a direction of thickness of a heat-sensitive recording material composed of the sheet-like substrate and a heat-sensitive recording layer formed on the sheet-like substrate. This causes an uneven contact of a thermal head with the surface of the heat-sensitive recording layer, resulting in poor uniformity of picture quality.

Thus, when base paper used in the present invention has an internal coupling force of 0.5 to 2 kgf·cm as defined in TAPPI USEFUL METHOD 403, preferably 0.5 to 1.9 kgf·cm, no problem arises in paper making and feed of a product, and also the product has excellent uniformity of picture quality. For this reason, the internal coupling force of base paper as defined in TAPPI USEFUL METHOD 403 is particularly desirable to be 0.5 to 1.9 kgf·cm.

In order to control the internal coupling force of base paper as described above, it is desirable to select an adequate type of pulp and to soften the pulp through beating to thereby adjust the Canadian freeness value of the pulp. The Canadian freeness value is an index indicating to what extent pulp is softened. As beating progresses, the Canadian freeness value reduces, and the internal coupling force of base paper increases. Also, the internal coupling force of base paper can be adjusted through adjustment of a percentage of addition of chemicals added to pulp. For example, as a percentage of addition of sizing agents such as epoxy fatty amides, alkyl ketene dimers, and fatty acid salts increases, the internal coupling force decreases. By contrast, as a percentage of addition of paper strength reinforcing agents such as polyacrylamide increases, the internal coupling force increases. Thus, through adjustment of a percentage of addition of these chemicals, the internal coupling force can be adjusted to a desired value.

A resin layer formed on both sides of paper base may be formed through melt extrusion coating or through dry lamination, i.e. a previously prepared resin film may be bonded onto base paper through use of an adhesive. Preferably, a resin layer is formed on base paper through melt extrusion coating. A resin to be layered over base paper through melt extrusion coating is preferably an olefin-based resin. Examples of such an olefin-based resin include homopolymers of α-olefin such as polyethylene and polypropylene, and mixtures of these homopolymers. Particularly preferred polyolefins are high-density polyethylene, low-density polyethylene, and their mixtures. The molecular weight of these polyolefins is not particularly limited so long as the polyolefins can melt-extrusion-coat the base paper surface. Normally, a polyolefin having a molecular weight of $10^4$ to $10^6$ is used.

When a previously prepared resin film is bonded onto base paper through use of an adhesive, the resin film is preferably of an olefin-based resin. Examples of such an olefin-based resin include homopolymers of α-olefin such as polyethylene and polypropylene, and mixtures of these homopolymers. Most preferably, the resin film is of polyethylene terephthalate.

When a resin layer is formed as a back layer on base paper on a side opposite to the side where a heat-sensitive recording layer is formed, a curl balance of the thus-formed sheet-like substrate can be attained. A poor curl balance of a sheet-like substrate affects a curl of a product recording material coated with a heat-sensitive recording layer, resulting in an adverse effect on feed performance of the recording material on a printer.

In the first multi-color heat-sensitive material of the present invention, a resin layer is formed on a support at least on a front side, i.e. a side where a heat-sensitive recording layer is formed. In other words, a resin layer may be formed on both sides of a support or only on a side where a heat-sensitive recording layer is formed. In the second multi-color heat-sensitive recording material of the present invention, a resin layer is formed on both sides of base paper. A resin layer formed on the front side, i.e. on the side where a heat-sensitive recording layer is formed, preferably contains a white pigment. Such a white pigment may be selected from known white pigments, and its proportion may also be a known proportion. Further, known additives such as fluorescent whitening agents and oxidation inhibitors may be added. Examples of such a white pigment to be added include titanium dioxide, barium sulfate, barium carbonate, calcium carbonate, lithopone, alumina white, zinc oxide, silica antimony trioxide, and titanium phosphate. These white pigments may be used singly or in combination. Of these white pigments, titanium dioxide and zinc oxide are preferred in view of brightness, dispersibility, and stability.

Titanium dioxide may be the rutile type or anatase type, and these two types of titanium dioxide may be used singly or in combination. Also, titanium dioxide may be prepared by a sulfuric acid method or a chlorine method. Titanium dioxide may undergo any of the following treatments: a surface coating treatment with an inorganic substance, such as a hydrous alumina treatment, a hydrous silicon dioxide treatment, or a zinc oxide treatment; a surface coating treatment with an organic substance such as trimethylolmethane, trimethylolethane, trimethylolpropane, or 2,4-dihydroxy-2-methylpentane; and a siloxane treatment with polydimethylsiloxane. A proportion of a white pigment in a resin layer depends on a white pigment used and the thickness of a resin layer, but is normally 5 wt. % to 20 wt. %. For extrusion coating with a thermoplastic resin such as polyolefin, a normal polyolefin extruder and a normal laminator are used.

It is preferred that a resin layer formed on base paper on a side where a heat-sensitive recording layer is formed (front side) be thicker than a resin layer formed on a side where no heat-sensitive recording layer is formed (back side). The resin layer on the front side influences the surface roughness of a sheet-like substrate. Thus, the resin layer thickness on the front side is preferably 10 to 80 $\mu$m. When the resin layer thickness on the front side is thinner than 10 $\mu$m or thicker than 80 $\mu$m, high-speed extrusion lamination becomes unstable, resulting in a deteriorated surface roughness of a sheet-like substrate.

In order to avoid any change caused by heat during thermal recording, the resin layer on the front side is preferably formed of a resin having a relatively high melting point. A resin for the front-side resin layer preferably has a melting point of not less than 80° C., preferably not less than 100° C., more preferably not less than 105° C. If a resin having a melting point of less than 80° C. is used, the resin layer will change upon exposure to heat from a thermal head during thermal recording, resulting in a deteriorated surface roughness of a sheet-like substrate.

Preferably, base paper is pretreated before it is extrusion-coated with a resin layer, to thereby strengthen bonding between base paper and the resin layer. Examples of such pretreatment of base paper include acid etching with a mixture of sulfuric acid and chromic acid; flame treatment with gas flame; irradiation with ultraviolet rays; corona discharge treatment; glow discharge treatment; and anchor-coating with alkyl titanate. In view of convenience, a corona discharge treatment is preferred. In a corona discharge treatment, an angle of contact with water must be not more than 70°.

Anchor-coating agents which have heretofore been known include those of the organic titanium-type, isocyanate-type (urethane-type), polyethyleneimine-type, and polybutadiene-type. Specific examples of known organic titanium-type agents include alkyl titanates such as tetraisopropyl titanate, tetrabutyl titanate, and tetrastearyl titanate; titanium acylates such as butoxy titanium stearate; and titanium chelates such as titanium acetyl acetonate. Specific examples of known isocyanate-type (urethane-type) agents include toluene diisocyanate (TDI), diphenylmethane diisocyanate (MDI), hexamethylene diisocyanate (HMDI), xylylene diisocyanate (XDI) and isophorone diisocyanate (IPDI).

In the first multi-color heat-sensitive recording material of the present invention, the surface of the sheet-like substrate (which comprises base paper and a resin layer formed on the base paper as described above) on the side where heat-sensitive recording layers are formed has a three-dimensional surface roughness of not more than 0.3 $\mu$m as measured at a filter wavelength of 0.8 to 2.5 mm.

The above-mentioned three-dimensional surface roughness indicates a central-surface average roughness (SRa), which is defined as follows. A portion having an area SM located at a central surface of a rough surface is considered. A rectangular coordinate system is placed on a central surface of the portion having an area SM such that its X-axis and Y-axis exist on the central surface and such that its Z-axis is perpendicular to the central surface. A value obtained by the following equation is defined as the central-surface average roughness (SRa), which is represented in the unit of $\mu$m.

$$SRa = \frac{1}{SM}\int_0^{LX}\int_0^{LY}\left|f(X,Y)\right| dx\,dy$$

where

LX·LY=SM z=f (X, Y)

The central-surface average roughness is obtained, for example, from the result of measurement conducted over an area of 400 $mm^2$ by a three-dimensional surface profile measuring machine (SURFCOM 575A-3DF) from Tokyo Seimitsu Co., Ltd., using a diamond needle having a radius of 2 $\mu$m, while wavelengths of 2.5 mm or more and 0.8 mm or less are cut off.

When the above-defined surface roughness is in excess of 0.3 $\mu$m, the surface smoothness of a heat-sensitive recording layer formed on the resin layer deteriorates. This causes uneven contact of a thermal head with the heat-sensitive recording layer surface during thermal recording, resulting in poor uniformity of picture quality.

During thermal recording, the sheet-like substrate surface on the side where a heat-sensitive recording layer is formed is exposed to heat from a thermal head. This heat deteriorates the flatness of the sheet-like substrate surface on the side where a heat-sensitive recording layer is formed, resulting in deterioration in a heat-sensitive recording layer. Thus, the surface roughness of the sheet-like substrate before thermal recording is preferably not more than 0.3 μm in central-surface average roughness (SRa) so that the surface roughness of the sheet-like substrate after thermal recording becomes not more than 0.4 μm in central-surface average roughness (SRa).

In order to strengthen bonding between the resin layer of polyolefin or a like resin and a heat-sensitive recording layer formed on the resin layer, the surface of the resin layer may be treated by corona discharge. Alternatively, a gelatin-based undercoat may be applied onto the corona-discharge-treated surface of the resin layer.

A polyethylene layer on the back side of base paper, i.e. on a side opposite to the side where a heat-sensitive recording layer is formed, normally has a matte surface. This polyethylene layer on the back side may be covered, as needed, with an antistatic layer which contains colloidal silica and ionic organic antistatic agents such as alkali metal salts of polymerizable carboxylic acid.

In the second multi-color heat-sensitive recording material of the present invention, a support comprises a sheet-like substrate which is formed such that a resin layer is formed on both sides of base paper. This sheet-like substrate must have a rigidity of 1.5 to 8.0 gf·cm as defined in JIS P8125 in a printing direction. The printing direction is a direction along which a heat-sensitive recording material is fed during printing. FIG. 1 shows the relation between a sheet-like substrate and a direction of printing on a multi-color heat-sensitive recording material. Normally, a multi-color heat-sensitive recording material comprises a band-like sheet-like substrate 11 composed of a sheet-like substrate and a heat-sensitive recording layer formed on one side of the sheet-like substrate, and is cut into a predetermined size to become a recording paper 12.

In FIG. 1, for example, when type A recording paper having a printing direction indicated by arrow A is prepared from the band-like sheet-like substrate 11, the band-like sheet-like substrate 11 must have a rigidity of 1.5 to 8.0 gf·cm as defined in JIS P8125 in direction A. By contrast, when type B recording paper having a printing direction indicated by arrow B is prepared from the band-like sheet-like substrate 11, the band-like sheet-like substrate 11 must have a rigidity of 1.5 to 8.0 gf·cm as defined in JIS P8125 in direction B.

The rigidity of a sheet-like substrate tends to increase with the thickness of base paper as well as with the basis weight of base paper. Also, this rigidity tends to increase as the proportion of LBKP to LBSP in material pulp increases. An effect of these factors on the rigidity of a sheet-like substrate increases in the order of pulp composition, basis weight of base paper, and thickness of base paper. Further, the rigidity of a sheet-like substrate increases as the thickness of a resin layer formed on both sides of base paper. Accordingly, the rigidity of a sheet-like substrate can be adjusted through an adequate selection of thickness of base paper, basis weight of base paper, pulp composition, and thickness of a resin layer. For example, the thickness of base paper is preferably 50 to 160 μm, the basis weight of base paper is preferably 60 to 170 g/m$^2$, and the thickness of a resin layer is preferably 10 to 80 μm. As shown in FIG. 1, the rigidity of paper is different between longitudinal and lateral directions. This anisotropy of rigidity may be utilized for obtaining a desired rigidity. A resin layer thickness falling outside the range of 10–80 μm is not only disadvantageous to adjustment of the substrate rigidity but also causes instability in melt extrusion coating at high speeds.

When the rigidity of a sheet-like substrate is less than 1.5 gf·cm as measured in accordance with JIS P8125 in a printing direction, the feed performance of a recording material deteriorates. By contrast, when this rigidity exceeds 8.0 gf·cm, contact of a thermal head with a heat-sensitive recording layer becomes uneven, resulting in uneven picture quality.

For improved uniformity of picture quality, a sheet-like substrate manufactured in the above-described method for a multi-color heat-sensitive material must has a high surface smoothness. Thus, the sheet-like substrate surface on which a multi-color heat-sensitive recording layer is formed preferably has a central-surface average roughness (SRa) of not more than 0.5 μm, more preferably not more than 0.2 μm.

Heat-sensitive recording layers, which will be described later, are formed on a sheet-like substrate as prepared in a manner described above, to thereby obtain a multi-color heat-sensitive recording material having excellent uniformity of picture quality. The heat-sensitive recording layers will next be described.

Figure 2:
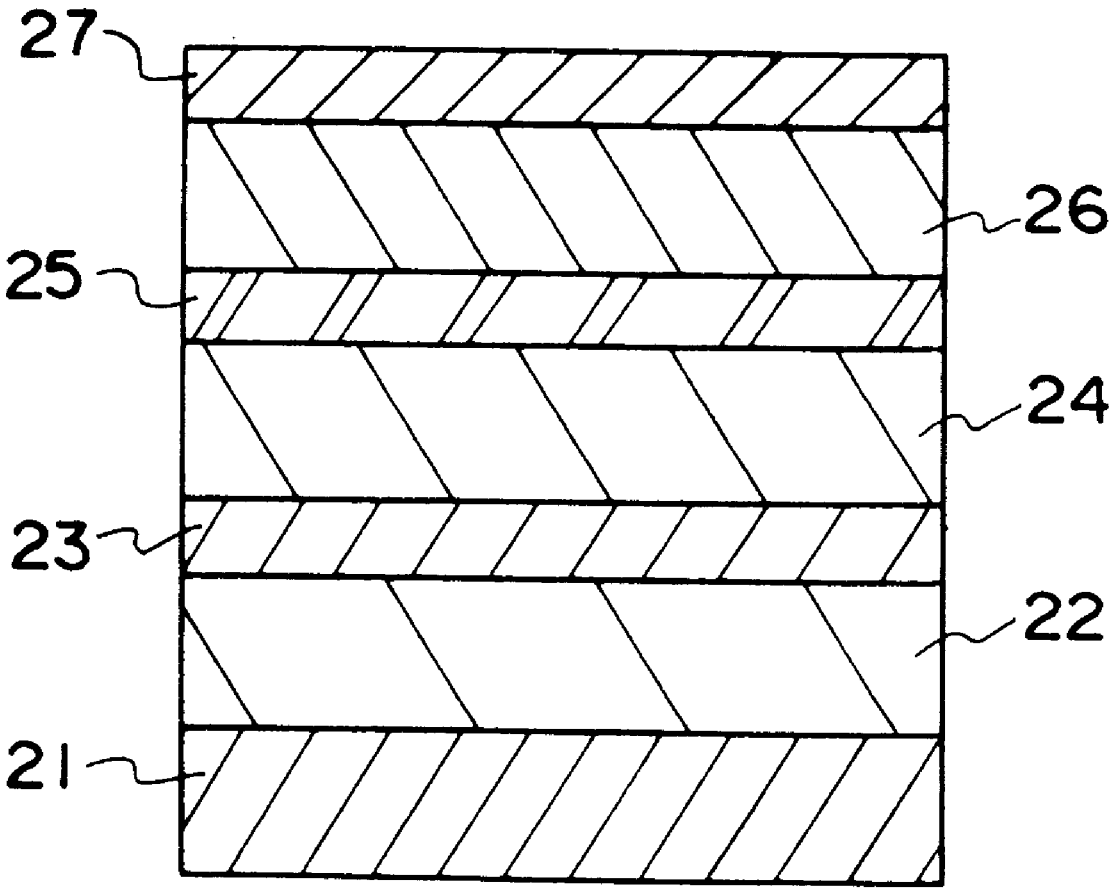
FIG. 2 is a sectional view showing an embodiment of a multi-color heat-sensitive recording material of the present invention.

In a multi-color heat-sensitive recording material shown in FIG. 2, a transparent cyan heat-sensitive layer 22, an intermediate layer 23, a transparent yellow heat-sensitive layer 24, an intermediate layer 25, and a transparent magenta heat-sensitive layer 26 are formed in layers in this order on one side of a sheet-like substrate 21, and the outermost magenta heat-sensitive layer 26 is covered with a transparent protective layer 27. In this case, at least the magenta heat-sensitive layer and the yellow heat-sensitive layer contain a diazo color-developing compound, and a color-developing compound which is contained in the cyan heat-sensitive layer may be or may not be a diazo compound. The diazo compounds are selected such that a diazo compound which is contained in an outer heat-sensitive layer is decomposed at a longer wavelength than that contained in an inner heat-sensitive layer.

Thermal recording is performed in the following manner. First, the outermost heat-sensitive layer is magenta-color developed through application of low thermal energy. Subsequently, a diazo compound which is contained in the outermost heat-sensitive layer is decomposed through irradiation with light having a photodegradation wavelength of the diazo compound, to thereby fix an image recorded in the outermost heat-sensitive layer.

Next, the intermediate heat-sensitive layer is yellow-color developed through application of thermal energy greater than that applied for the above-described thermal recording on the outermost heat-sensitive layer. Subsequently, a diazo compound which is contained in the intermediate heat-sensitive layer is decomposed through irradiation with light having a photodegradation wavelength of the diazo compound, to thereby fix an image recorded in the intermediate heat-sensitive layer. When the innermost heat-sensitive layer also contains a diazo color-developing compound, the recording material is also irradiated with light having a photodegradation wavelength of the diazo compound, to thereby fix an image recorded in the innermost heat-sensitive layer. This prevents the occurrence of stains in the background due to aging.

As described above, since cyan, magenta, and yellow can be color-developed independently of each other, seven basic colors of cyan, magenta, yellow, blue (cyan+magenta), red (magenta+yellow), green (cyan+yellow), and black (cyan+magenta+yellow) can be developed with good color differentiation, which is said to be difficult to achieve in conventional thermal recording. In this case, it will be apparent to skilled artisans that even when the innermost heat-sensitive layer is opaque, it has no adverse effect on color reproduction.

Of course, the above-mentioned transparent protective layer is not necessarily required if the outermost heat-sensitive layer has sufficient resistance against abrasion and sticking. Also, it will be apparent to skilled artisans that the number of colors realizable through color amalgamation is synergetically increased through adjustment of applied thermal energy to thereby control color generation of each unit.

As described above, in the present invention, a color-developing compound which is contained in the innermost heat-sensitive layer may not be a diazo compound. In this case, a color-developing compound other than a diazo compound is preferably a combination of an electron-donating dye precursor and a developer (leuco compound) from the viewpoint of thermal sensitivity and color density.

A variety of components used in a multi-color heat-sensitive recording material of the present invention will next be described in detail.

Electron-donating dye precursors used in the present invention are those compounds which donate electrons or receive protons to thereby develop colors, and are not particularly limited. These electron-donating dye precursors are normally substantially colorless compounds which have lactone, lactam, sulfone, spiropyran, ester, amide, or like moieties, which are ring-opened or cleaved upon contact with a developer. Specific examples of these precursors include Crystal Violet lactone, benzoyl leuco methylene blue, Malachite Green lactone, Rhodamine B lactam, and 1,3,3-trimethyl-6'-ethyl-8'-butoxyindolyno-benzospiropyran.

Developers for these color-generating agents may be selected from among known developers. Examples of developers for leuco dyes include phenol compounds, sulfur-containing phenol-type compounds, carboxylic acid-type compounds, sulfone-type compounds, and urea-type or thiourea-type compounds. These compounds are described in detail, for example, in Paper and Pulp Technology Times (1985), pp. 49–54, 65–70. Of these compounds, compounds having a melting point of 50 to 250° C. are preferable, and more preferable are phenol compounds and organic acid compounds which are hard to dissolve in water and have a melting point of 60 to 200° C. Two or more developers are preferably used in combination because of an increase in solubility.

Of the developers which are used in the present invention, those particularly preferred are the following compounds of formulas (1) through (4).

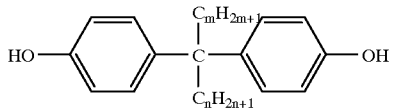

(1)

wherein m is from 0 to 2, and n is from 2 to 11.

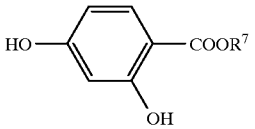

(2)

wherein $R^7$ is alkyl, aryl, aryloxyalkyl or aralkyl, with methyl and butyl being particularly preferred.

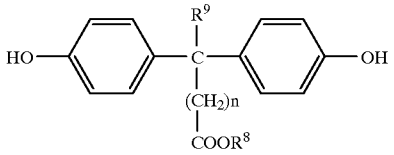

(3)

wherein $R^8$ is alkyl, with butyl, pentyl, heptyl, and octyl being particularly preferred, $R^9$ is hydrogen or methyl, and n is from 0 to 2.

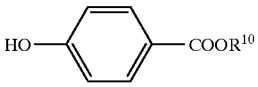

(4)

wherein $R^{10}$ is alkyl, aralkyl, or aryloxyalkyl.

In the present invention, 0.3 to 160 parts by weight, preferably 0.3 to 80 parts by weight of developers are used for 1 part by weight of electron-donating dye precursors.

Diazo compounds used as color-generating agents in a multi-color heat-sensitive recording material of the present invention generate desired hues upon reaction with developers called couplers, which will be described later. Further, when these diazo compounds are irradiated with light having a certain wavelength before reaction with developers, they decompose and lose the color-generating capability, and thus do not generate hues even though couplers act thereon.

The thus generated hues are primarily determined by diazo dyes generated by reaction between diazo compounds and couplers. Thus, as known well, through modification of the chemical structure of a diazo compound or of a coupler, a hue to be generated can be changed. Also, a certain hue can be generated substantially as desired, through selection of an adequate combination of a diazo compound and a coupler.

In the present invention, photodegradable diazo compounds primarily denote aromatic diazo compounds, specifically aromatic diazonium salts, diazosulfonate compounds, and diazoamino compounds. Diazonium salts will be described below by way of example.

Normally, a photodegradation wavelength of a diazonium salt is said to be an absorption maximum wavelength of the diazonium salt. An absorption maximum wavelength of a diazonium salt is known to range from about 200 nm to about 700 nm in accordance with the chemical structure of the diazonium salt (Takahiro TUNODA, Tuguo YAMAOKA, "Photodegradation and Chemical Structure of Photosensitive Diazonium Salts," Journal of The Society of Photographic Science and Technology of Japan, Vol. 29 (4), pp. 197–205 (1965)). Also, through modification of the chemical structure of a diazonium salt, coupling reaction of the diazonium salt with a coupler causes a resulting dye to have a hue different from that obtained from coupling reaction with the same coupler before the chemical structure is modified.

Diazonium salts are represented by the formula $ArN_2^+X^-$, where Ar represents a substituted or unsubstituted aromatic moiety, $N_2^+$ represents a diazonium group, and $X^-$ represents an acid anion.

Among the above-described compounds, those having a photodegradation wavelength in the vicinity of 400 nm include 4-diazo-1-dimethylaminobenzene, 4-diazo-1-diethylaminobenzene, 4-diazo-1-dipropylaminobenzene, 4-diazo-1-methylbenzylaminobenzene, 4-diazo-1-dibenzylaminobenzene, 4-diazo-1-ethylhydroxyethylaminobenzene, 4-diazo-1-diethylamino-3-methoxybenzene, 4-diazo-1-dimethylamino-2-methylbenzene, 4-diazo-1-benzoylamino-2,5-diethoxybenzene, 4-diazo-1-morpholinobenzene, 4-diazo-1-morpholino-2,5-dibutoxybenzene, 4-diazo-1-anilinobenzene, 4-diazo-1-toluylmercapto-2,5-diethoxybenzene, and 4-diazo-1,4-methoxybenzoylamino-2,5-diethoxybenzene.

Examples of compounds having a photodegradation wavelength in the range of 300–370 nm include 1-diazo-4-(N,N-dioctylcarbamoyl)benzene, 1-diazo-2-octadecyloxybenzene, 1-diazo-4-(4-tert-octylphenoxy)benzene, 1-diazo-4-(2,4-di-tert-amylphenoxy)benzene, 1-diazo-2-(4-tert-octylphenoxy)benzene, 1-diazo-5-chloro-2-(4-tert-octylphenoxy)benzene, 1-diazo-2,5-bis-octadecyloxybenzene, 1-diazo-2,4-bis-octadecyloxybenzene, and 1-diazo-4-(N-octyllauroyamino)benzene. By arbitrarily replacing substituents of aromatic diazonium compounds typified by these examples, their photodegradation wavelength may be altered in a wide range.

Specific examples of the acid anion include $C_nF_{2n+1}COO^-$ (wherein n is from 3 to 9), $C_mF_{2m+1}SO_3^-$ (wherein m is from 2 to 8), and $(ClF_{2i+1}SO_2)_2CH^-$ (wherein i is from 1 to 18).

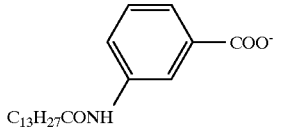

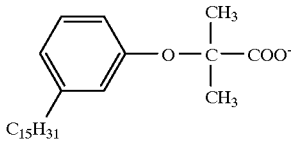

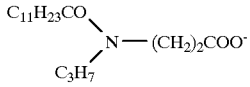

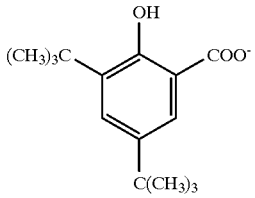

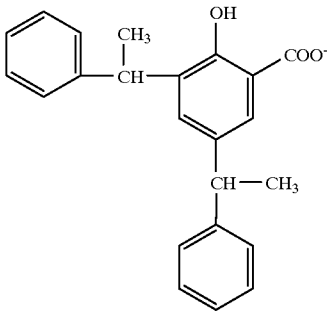

Specific examples of the diazo compound (diazonium salt) include the following.

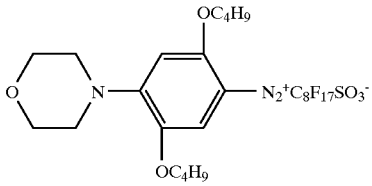

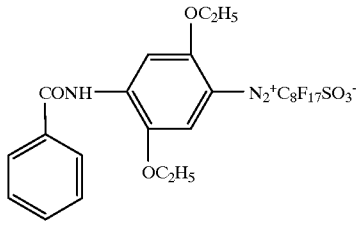

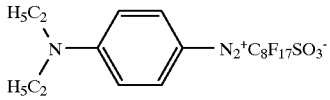

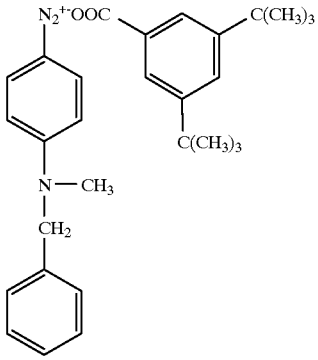

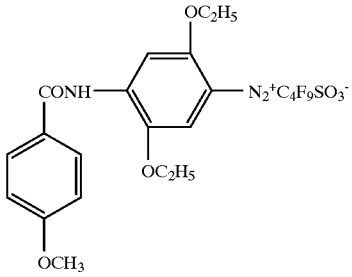

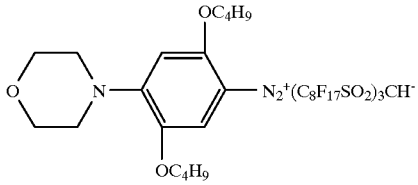

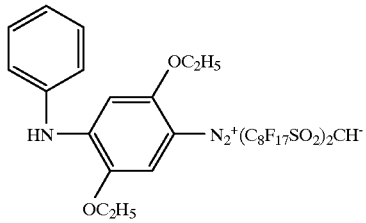

-continued

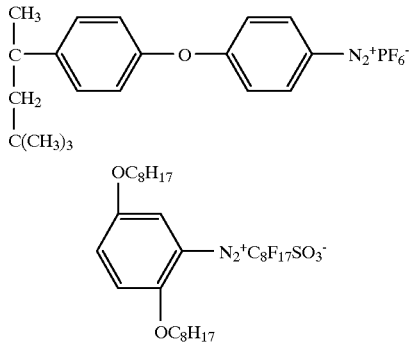

The diazosulfonate compounds which are used in the present invention are represented by the following formula:

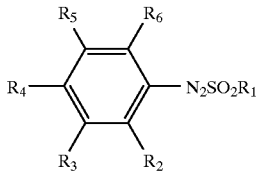

wherein $R_1$ is an alkali metal or an ammonium compound, each of $R_2$, $R_3$, $R_5$, and $R_6$ represents hydrogen, halogen, alkyl, or alkoxy, and $R^4$ is hydrogen, halogen, alkyl, amino, benzoylamide, morpholino, trimercapto, or pyrrolidino.

Many diazosulfonate compounds of this kind are known and obtained through treatment of corresponding diazonium salts with sulfite.

Of these compounds, preferred ones are benzene diazosulfonates having substituents such as 2-methoxy, 2-phenoxy, 2-methoxy-phenoxy, 2,4-dimethoxy, 2-methyl-4-methoxy, 2,4-dimethyl, 2,4,6-trimethyl, 4-phenyl, 4-phenoxy, and 4-acetamide as well as benzene diazosulfonates having substituents such as 4-(N-ethyl, N-benzylamino), 4-(N,N-dimethylamino), 4-(N,N-diethylamino), 4-(N,N-diethylamino)-3-chloro, 4-pyrrolidino-3-chloro, 4-morpholino-2-methoxy, 4-(4'-methoxybenzoylamino)-2,5-dibutoxy, and 4-(4'-trimercapto)-2,5-dimethoxy. When these diazosulfonate compounds are used, it is preferable that irradiation with light be performed to activate diazosulfonate before printing.

Other diazo compounds usable in the present invention include diazoamino compounds. These diazoamino compounds are obtained through coupling of a diazo group with dicyandiamide, sarcosine, methyl taurine, N-ethyl anthranic acid-5-sulfonic acid, monoethanolamine, diethanolamine, and guanidine.

The couplers which are used in the present invention form dyes through coupling with diazo compounds (diazonium salts). Specific examples of the couplers include resorcin, phloroglycine, sodium 2,3-hydroxynaphthalene-6-sulfonate, 1-hydroxy-2-naphthoic acid morpholinopropylamide, 1,5-dihydroxynaphthalene, 2,3-dihydroxynaphthalene, 2,3-dihydroxy-6-sulfanylnaphthalene, 2-hydroxy-3-naphthoic acid morpholinopropylamide, 2-hydroxy-3-naphthoic acid-2'-methyl amide, 2-hydroxy-3-naphthoic acid ethanol amide, 2-hydroxy-3-naphthoic acid octyl amide, 2-hydroxy-3-naphthoic acid tetradecyl amide, acetanilide, acetacetanilide, benzoyl acetanilide, 1-phenyl-3-methyl-5-pyrazolone, 2,4-bis(benzoylacetamino)toluene, 1,3-bis(pivaloylacetaminomethyl)benzene, 1-(2',4',6'-trichlorophenyl)-3-benzamide-5-pyrazolone, 1-(2',4',6'-trichlorophenyl)-3-anilino-5-pyrazolone, and 1-phenyl-3-phenylacetamide-5-pyrazolone.

Further, by use of two or more of these couplers in combination, an image having a desired color tone can be obtained. Since the coupling reaction of these diazo compounds with couplers is more likely to take place in a basic environment, a basic substance may be added to a layer.

Basic substances used for this purpose include basic substances which are slightly soluble in water or insoluble in water, and those substances which generate alkali when heated. Examples of these substances include nitrogen-containing compounds such as inorganic and organic ammonium salts, organic amines, amides, urea and thiourea and their derivatives, thiazoles, pyrroles, pyrimidines, piperazines, guanidines, indoles, imidazoles, imidazolines, triazoles, morpholines, piperidines, amidines, formamidines, and pyridines. Specific examples of these compounds are described in, for example, Japanese Patent Application No. 60-132990. Two or more of these basic substances may be used in combination.

Preferably, 0.1 to 10 parts by weight of couplers and 0.1 to 20 parts by weight of basic substances are used for 1 part by weight of diazo compounds.

Preferably, for the above-described materials associated with color-generating reactions, part of their components essential to color generation are encapsulated in view of the following: improved transparency of heat-sensitive layers; improved green-state preservation of heat-sensitive layers through prevention of contact of color-generating agents with developers at room temperature (antifogging); and control of sensitivity of color generation through control of applied energy.

In this case, the type of microcapsules used in the present invention is not particularly limited. Preferably, microcapsules are such that a microcapsule wall prevents contact of substances inside a capsule and substances outside the capsule through a substance isolation effect of the microcapsule wall at room temperature and such that the substance permeability of the microcapsule wall increases only when heated in excess of a certain temperature. Microcapsules are also preferably such that a permeation starting temperature can be freely controlled through an adequate selection of a capsule wall material, a capsule core material, and additives. In this case, the permeation starting temperature corresponds to the glass-transition temperature of a capsule wall as described in, for example, Japanese Patent Application Laid-Open (JP-A) No. 59-91438 and Japanese Patent Applications Nos. 59-190886 and 59-99490.

In order to control a glass-transition temperature intrinsic to a capsule wall, materials of the capsule wall must be changed. Materials for a microcapsule wall include polyurethane, polyurea, polyester, polycarbonate, a urea-formaldehyde resin, a melamine resin, polystyrene, styrene methacrylate copolymers, styrene-acrylate copolymers, gelatin, polyvinyl pyrrolidone, and polyvinyl alcohol. In the present invention, two or more of these polymer substances may be used in combination. In the present invention, of these polymer substances, polyurethane, polyurea, polyamide, polyester, and polycarbonate are preferable, and polyurethane and polyurea are more preferable.

Microcapsules used in the present invention are preferably prepared such that after emulsification of a core substance which contains reactive substances such as color-generating agents, individual oil droplets are enclosed with a wall of a polymer substance to thereby form microcapsules. In this case, a reactant for forming the polymer substance is added to the interior and/or exterior of oil droplets. The details of microcapsules preferably used in the present invention, including a preferable manufacturing method for microcapsules, are described in, for example, Japanese Patent Application Laid-Open (JP-A) No. 59-222716.

An organic solvent for forming oil droplets may be suitably selected from oils having a high boiling point. Particularly, an organic solvent suited for dissolving developers or couplers, which will be described later, is preferred because such an organic solvent shows an excellent solubility for color-generating agents, increases a color density and a color generation rate during thermal printing, and reduces fog. Microcapsules may be prepared from an emulsion which contains a component to be formed into microcapsules in the amount of not less than 0.2 wt. %.

In contrast with those microcapsules used in a conventional recording material which break upon exposure to heat or pressure, the above-described preferable microcapsules allow an reactive substance to bidirectionally permeate through a microcapsule wall to thereby undergo a color-generating reaction.

In the present invention, color generation aids may be used. Such color generation aids are substances for increasing a color density or decreasing a minimum color generation temperature during thermal printing. These aids lower a melting point of couplers, basic substances, color-generating agents, and developers or diazo compounds as well as a softening point of a capsule wall to thereby establish a condition suited for a mutual reaction of diazo compounds, basic substances, couplers, color-generating agents, and developers.

Color generation aids include phenol compounds, alcoholic compounds, amide compounds, and sulfonamide compounds. Specific examples of such color generation aids include p-tert-octylphenol, p-benzyloxyphenol, p-oxyphenyl benzoate, benzyl carbanate, phenethyl carbanate, hydroquinone dihydroxyethyl ether, xylylene diol, N-hydroxyethylmethanesulfonic acid amide, and N-phenyl-methanesulfonic acid amide. These compounds may be contained in a core substance or may be added, as an emulsified substance, to the exterior of microcapsules.

In the present invention, in order to obtain a substantially transparent heat-sensitive color-generating layer, developers for electron-donating dye precursors or couplers for diazo compounds are dissolved in an organic solvent which is hard to dissolve in water or insoluble in water. The resulting solution is mixed with an aqueous phase which contains surfactants and has water-soluble polymers as protective colloid, to thereby obtain emulsified developers or couplers.

An organic solvent for dissolving developers or couplers may be suitably selected from oils having a high boiling point. Preferred organic solvents are esters and certain oils that are known as pressure-sensitive oils with two or more benzene rings in which the number of heterogeneous atoms does not exceed a predetermined number. Examples of these oils include compounds represented by formulas (5) to (7) shown below, triallylmethanes (for example, tritoluilmethane, toluildiphenylmethane), terphenyl compounds, alkyl compounds (for example, terphenyl), alkylated diphenyl ethers (for example, propyl diphenyl ether), hydrogenated terphenyls (for example, hexahydroterphenyl), and diphenyl ethers. Particularly, use of esters is preferable in view of emulsion stability of emulsified developers or couplers.

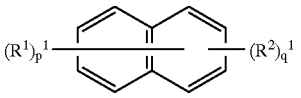

(5)

wherein $R^1$ is hydrogen or C1–C18 alkyl, $R^2$ is C1–C18 alkyl, and each of $p^1$ and $q^1$ is an integer between 1 and 4, and the sum of the numbers of the alkyl groups is not more than 4. Preferably, the alkyl groups represented by $R^1$ and $R^2$ are C1–C8 alkyl.

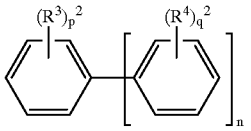

(6)

wherein $R^3$ is hydrogen or C1–C12 alkyl, $R^4$ is C1–C12 alkyl, n is 1 or 2, and each of $p^2$ and $q^2$ is an integer between 1 and 4. When n is equal to 1, the sum of the numbers of the alkyl groups is not more than 4, and when n is equal to 2, the sum of the numbers of the alkyl groups is not more than 6.

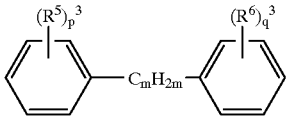

(7)

wherein each of $R^5$ and $R^6$, which may be identical to or different from each other, is hydrogen or C1–C18 alkyl, m is an integer between 1 and 13, and each of $p^3$ and $q^3$ is an integer between 1 and 3, and the sum of the numbers of the alkyl groups is not more than 3. Preferably, the alkyl groups represented by $R^5$ and $R^6$ are C2–C4 alkyl.

Compounds represented by formula (5) include dimethylnaphthalene, diethylnaphthalene, and diisopropylnaphthalene.

Compounds represented by formula (6 include dimethylbiphenyl, diethylbiphenyl, diisopropylbiphenyl, and diisobutylbiphenyl.

Compounds represented by formula (7) include 1-methyl-1-dimethylphenyl-1-phenylmethane, 1-ethyl-1-dimethylphenyl-1-phenylmethane, and 1-propyl-1-dimethylphenyl-1-phenylmethane.

Examples of esters include phosphoric acid esters (for example, triphenyl phosphate, tricresyl phosphate, butyl phosphate, octyl phosphate, and cresyldiphenyl phosphate, phthalic acid esters (for example, dibutyl phthalate, 2-ethylhexyl phthalate, ethyl phthalate, octyl phthalate, and butylbenzyl phthalate), dioctyl tetrahydrophthalate, benzoic acid esters (for example, ethyl benzoate, propyl benzoate, butyl benzoate, isobutyl benzoate, and benzyl benzoate), abietic acid esters (for example, ethyl abietate and benzyl abietate), dioctyl adipate, isodecyl succinate, dioctyl azelate, oxalic acid esters (for example, dibutyl oxalate, and dipentyl oxalate), diethyl malonate, maleic acid esters (for example, dimethyl maleate, diethyl maleate, and dibutyl maleate), tributyl citrate, sorbic acid esters, (methyl sorbate, ethyl sorbate, and butyl sorbate), sebacic acid esters (for example, dibutyl sebacate and dioctyl sebacate), ethylene glycol esters (for example, mono- and di-esters of formic acid, mono- and di-esters of butyric acid, mono- and di-esters of lauric acid, mono- and di-esters of palmitic acid, mono- and di-esters of stearic acid, and mono- and di-esters of oleic acid), triacetin, diethyl carbonate, diphenyl carbonate, ethylene carbonate, propylene carbonate, and boric acid esters (for example, tripentyl borate).

The above-described oils may be used in combination among them or they may be used in combination with other oils.

In the present invention, auxiliary solvents serving as dissolving aids having a low boiling point may be added to the above-described organic solvents. Particularly preferred such auxiliary solvents include ethyl acetate, isopropyl acetate, butyl acetate, and methylene chloride.

Water soluble polymers to be contained as protective colloid in an aqueous phase, which is mixed with an oil phase in which developers or couplers are dissolved, may be suitably selected from known anionic polymers, nonionic polymers, and amphoteric polymers. Particularly, polyvinyl alcohol, gelatin, and cellulose derivatives are preferable.

Surfactants to be contained in an aqueous phase may be suitably selected from anionic or nonionic surfactants which do not cause precipitation and aggregation through interaction with the above-described protective colloid. Preferable surfactants include sodium alkyl benzene sulfonate (for example, sodium lauryl sulfate), sodium dioctyl sulfosuccinate, and polyalkylene glycol (for example, polyoxyethylene nonyl phenyl ether).

Emulsification-dispersed developers or couplers used in the present invention can be readily obtained in the following manner. An oil phase which contains developers or couplers and an aqueous phase which contains protective colloid and surfactants are mixed and dispersed by a method used normally for emulsification of particles. Examples of such a method include high-speed stirring and ultrasonic dispersion.

In order to obtain a transparent heat-sensitive phase having a haze of not more than 60%, the thus-obtained emulsified substance preferably has an oil droplet size (diameter) of not more than $7\mu$, more preferably 0.1 to $5\mu$.

The ratio of an oil phase to an aqueous phase (weight of the oil/weight of the aqueous phase) is preferably 0.02 to 0.6, more preferably 0.1 to 0.4. When the ratio is not more than 0.02, the aqueous phase becomes too dominant, resulting a thin solution. This causes insufficient color generation. When the ratio is not less than 0.6, the viscosity of the solution increases, resulting in an inconvenience of handling and a reduction in transparency.

In the present invention, in addition to the above-described materials, citric acid, tartaric acid, oxalic acid, boric acid, phosphoric acid, and pyrophosphoric acid may be added as acid stabilizers.

A heat-sensitive material of the present invention may be applied through use of an adequate binder.

Binders usable for the present invention are emulsions of polyvinyl alcohol, methyl cellulose, carboxymethyl cellulose, hydroxypropyl cellulose, gum arabic, gelatin, polyvinyl pyrrolidone, casein, styrene-butadiene latex, acrylonitrile-butadiene latex, polyvinyl acetate, polyacrylate, and ethylene-vinyl acetate copolymers. The amount of binders reduced to the solid content is 0.5 to 5 $g/m^2$.

The amount of formation of a heat-sensitive layer is 3 to 20 $g/m^2$, preferably 5 to 15 $g/m^2$. When the amount of formation is not more than 3 $g/m^2$, a sufficient sensitivity cannot be obtained. When the amount of formation is not less than 20 $g/m^2$, an improvement of picture quality is not observed, and thus a thicker formation is disadvantageous in terms of cost. In the present invention, it is preferable that an intermediate layer be interposed between heat-sensitive layers, in view of improved green-state preservation of a heat-sensitive recording material, improved preservation of recorded images, and improved color differentiation. The intermediate layer is preferably formed by bringing a water soluble polyanionic polymers to be gelled by use of a polyvalent cationic substance.

Water soluble polyanionic polymers preferably have a carboxyl group, a sulfo group, and a phosphoric group. Particularly, water soluble polyanionic polymers having a carboxyl group are more preferable. Examples of preferable water soluble polyanionic polymers include natural or synthetic polysaccharide gums (for example, alkali metal salts of alginic acid, guar gum, gum arabic, carrageenan, pectin, tragacanth gum, and xanthene gum), polymers and copolymers of acrylic acid or methacrylic acid, polymers and copolymers of maleic acid or phthalic acid, cellulose derivatives such as carboxymethyl cellulose, gelatin, and agar, among which alkali metal salts of alginic acid are particularly preferred. The molecular weight of water soluble polyanionic polymers is preferably 5,000 to 10,000, more preferably 10,000 to 40,000 in view of a good barrier property and a good suitability for manufacture which the present invention intends to achieve. Preferable polyvalent cationic substances include salts of alkaline earth metals and other polyvalent metals (for example, $CaCl_2$, $BaCl_2$, $Al_2(SO_4)_3$, and $ZnSO_4$), polyamines (for example, ethylene diamine, diethylene triamine, and hexamethylene diamine), and polyimines.

Another preferable intermediate layer usable in the present invention is an ion complex comprising water soluble polyanionic polymers and water soluble polycationic polymers. In this case, the aforementioned various water soluble polyanionic polymers may be used.

Preferable water soluble polycationic polymers include proteins having a plurality of reactive nitrogen-containing cation groups, polypeptides such as polylysine, polyvinylamines, polyethyleneamines, and polyethyleneimines.

When an intermediate layer is formed using the aforementioned materials, either water soluble polyanionic polymers or polyvalent cations are preferably contained in one of adjacent heat-sensitive layers to thereby prevent accelerated gelling during application of the intermediate layer materials. Further, temperature and pH may be adjusted, and soluble polyanionic polymers or polyvalent cations contained in one adjacent heat-sensitive layer may also be contained in the other adjacent heat-sensitive layer.

The amount of formation of an intermediate layer is preferably 0.05 to 5 $g/m^2$, more preferably 0.1 to 2 $g/m^2$.

In the present invention, in order to attain an improved color differentiation, at least the outermost and intermediate heat-sensitive layers must be substantially transparent. The expression "substantially transparent" means that a haze must be not more than 60% as measured by an integrating sphere type HTR meter from Nippon Seimitsu Kogyo Co., Ltd. A haze is preferably not more than 40%, more preferably not more than 30%. In an actual transparency test on a heat-sensitive layer sample, scattering of light caused by fine roughness on the heat-sensitive layer surface greatly influences measurements. Accordingly, when transparency intrinsic to a heat-sensitive layer, i.e. transparency of the interior of a heat-sensitive layer is measured by a haze meter in order to obtain transparency related to the present invention, transparent adhesive tape is attached onto a heat-sensitive layer sample to thereby substantially remove scattering of light on the layer surface. Thus measured haze values are used for evaluation.

The above-mentioned transparency can be readily attained through use of developers or couplers in the form of an emulsified substance.

In a heat-sensitive recording material of the present invention, it is preferable that an outermost heat-sensitive layer be covered with a protective layer for improved resistance against abrasion and for preventing sticking. Two or more protective layers may be arranged. A transparent protective layer usable in the present invention comprises at least silicon-modified polyvinyl alcohol and colloidal silica.

The above-described silicon-modified polyvinyl alcohol is not particularly limited so long as silicon atoms are contained in molecules. Preferably, silicon atoms which are contained in molecules have a reactive substituent such as an alkoxyl group, an acyloxyl group, or a hydroxyl group obtained through hydrolysis or its alkali metal salt. A method of manufacturing modified polyvinyl alcohol in which silicon atoms are contained in molecules is described in detail in Japanese Patent Application Laid-Open (JP-A) No. 58-193189.

Colloidal silica used in the present invention is a colloidal solution wherein ultrafine particles of silicic acid anhydride is dispersed in water serving as a dispersion medium. Colloidal silica particles preferably have a size of 10 to 100 $\mu$m and a specific gravity of 1.1 to 1.3. In this case, the colloidal solution preferably has pH of about 4 to 10.

When a heat-sensitive recording material is covered with the above-described protective layer, an on-surface scattering of light is suppressed as in the aforementioned case where transparent adhesive tape is applied. Further surprisingly, the protective layer has excellent transparency. Since the protective layer improves a mechanical strength of the heat-sensitive layer surface, transparency of the entire heat-sensitive recording material can be significantly improved.

In the present invention, colloidal silica is mixed with 1 part by weight of silicon-modified polyvinyl alcohol preferably in the amount of 0.5 to 3 parts by weight, more preferably 1 to 2 parts by weight. When the amount of use of colloidal silica is less than 0.5 parts by weight, the effect of improving transparency is small. By contrast, when the amount of use is not less than 3 parts by weight, the protective layer cracks, and thus its transparency rather decreases.

Further, one or more species of polymers may be used in the transparent protective layer. Examples of such polymers include water soluble polymers such as methylcellulose, carboxymethylcellulose, hydroxymethylcellulose, starches, gelatin, gum arabic, casein, styrene-maleic anhydride copolymer hydrolysates, styrene-maleic anhydride copolymer half ester hydrolysates, polyvinyl alcohol, carboxy-modified polyvinyl alcohol, polyacrylamide derivatives, polyvinyl pyrrolidone, sodium polystyrene sulfonate, and sodium alginate, and water insoluble polymers such as styrene-butadiene rubber latex, acrylonitrile-butadiene rubber latex, methyl acrylate-butadiene rubber latex, and polyvinyl acetate emulsion. The amount of use of such a polymer is preferably in the amount of 0.01 to 0.5 parts by weight for 1 part by weight of silicon-modified polyvinyl alcohol.

Pigments, metal soap, waxes, and cross linking agents are added to the protective layer in order to improve a property of matching with a thermal head during thermal printing and water resistance of the protective layer.

Pigments preferably have a refractive index of 1.4 to 1.55 and a grain size of not more than 1$\mu$. Specific examples of pigments include calcium carbonate, talc, agalmatolite, kaolin, aluminum hydroxide, and amorphous silica. The amount of addition of pigments is 0.05 to 0.5 times the total weight of polymers, preferably 0.1 to 0.3 times. When the amount of addition is not more than 0.05 times, no improvement is attained in the property of matching with a thermal head. When the amount of addition is not less than 0.5 times, transparency and heat sensitivity of a heat-sensitive recording material significantly deteriorate, resulting in a damaged marketability.

Examples of metal soap include emulsions of higher fatty acid metal salts such as zinc stearate, calcium stearate, and aluminum stearate. The amount of addition of metal soap is 0.5 to 20 wt. % of the total weight of a protective layer, preferably 1 to 10 wt. %.

Examples of waxes include emulsions of paraffin wax, microcrystalline wax, carnauba wax, methylol stearamide, polyethylene wax, and silicone. The amount of addition of wax is 0.5 to 40 wt. % of the total weight of a protective layer, preferably 1 to 20 wt. %.

In order to evenly form a protective layer on a heat-sensitive layer, surfactants are added to a material solution for a protective layer. Surfactants include sulfosuccinate-type alkali metal salts and fluorine-containing surfactants. Specific examples of surfactants include sodium salts or ammonium salts of di-(2-ethylhexyl)sulfosuccinate and di-(n-hexyl)sulfosuccinate. Also, surfactants and polyelectrolytes to prevent static build-up of a heat-sensitive recording material may also be added to the protective layer.

The amount of application of the protective layer material in the form of solid is preferably 0.2 to 5 g/m$^2$, more preferably 1 to 3 g/m$^2$.

In the present invention, in order to improve bonding between a support and a heat-sensitive layer, an undercoat layer may be formed therebetween. Materials for the undercoat layer include gelatin, synthetic polymer latex, and nitrocellulose. The amount of application of the undercoat is preferably 0.1 to 2.0 g/m$^2$, more preferably 0.2 to 1.0 g/m$^2$. When the amount of application is less than 0.1 g/m$^2$, bonding between a support and a heat-sensitive layer becomes insufficient. By contrast, even when the amount of application is increased to 2.0 g/m$^2$ or more, this is disadvantageous in terms of cost because a bonding force between a support and a heat-sensitive layer is already saturated.

When a heat-sensitive layer is formed on an undercoat layer, water which is contained in the applied solution of the heat-sensitive layer may cause the undercoat layer to swell. This will cause the quality of an image recorded in the heat-sensitive layer to deteriorate. Thus, it is preferable that the undercoat layer be hardened through use of a hardening agent. Hardening agents usable in the present invention include the following.

(1) Active vinyl compounds such as divinylsulfone-N,N'-ethylenebis-(vinylsulfonylacetamide), 1,3-bis(vinylsulfonyl)-2-propanol, methylenebismaleimide, 5-acetyl-1,3-diacryloyl-hexahydro-s-triazine, and 1,3,5-trivinylsulfonyl-hexahydro-s-triazine.

(2) Active halogen compounds such as sodium 2,4-dichloro-6-hydroxy-s-triazine, 2,4-dichloro-6-methoxy-s-triazine, sodium 2,4-dichloro-6-(4-sulfoanilino)-s-triazine, 2,4-dichloro-6-(2-sulfoethylamino)-s-triazine, and N,N'-bis(2-chloroethylcarbamyl)piperazine.

(3) Epoxy compounds such as bis(2,3-epoxypropyl)methylpropylammonium p-toluenesulfonate, 1,4-bis(2',3'-epoxypropyloxy)butane, 1,3,5-triglycidylisocyanurate, and 1,3-diglycidyl-5-(gamma-acetoxy-beta-oxypropyl)isocyanurate.

(4) Ethyleneimino compounds such as 2,4,6-triethylene-s-triazine, 1,6-hexamethylene-N,N'-bisethylene urea, and bis-beta-ethyleneiminoethyl thioether.

(5) Methane sulfonis acid esters such as 1,2-di (methanesulfonoxy)ethane, 1,4-di(methanesulfonoxy) butane, and 1,5-di(methanesulfonoxy)pentane.

(6) Carbodiimides such as dicyclohexylcarbodiimide, 1-cyclohexyl-3-(3-trimethylaminopropyl)carbodiimide-p-toluenesulfonate, and 1-ethyl-3-(3-dimethylaminopropyl) carbodiimide hydrochloride.

(7) Isoxazoles such as 2,5-dimethylisoxazole perchloride, 2-ethyl-5-phenylisoxazole-3'-sulfonate, and 5,5'-(paraphenylene)bisisoxazole.

(8) Inorganic compounds such as chromium alum and chlomium cetate.

(9) Active ester-type compounds such as dehydration-condensated peptide reagents (e.g., N-carboethoxy-2-isopropoxy-1,2-dihydroquinoline and N-(1-morpholinocarboxy)-4-methylpyridinium chloride; and N,N'-adipoyl dioxydisuccinimide and N,N'-terephthaloyl

(10) Isocyanates such as toluene-2,4-diisocyanate and 1,6-hexamethylene diisocyanate.

(11) Dialdehydes such as glutaraldehyde, glyoxal, dimethoxy urea, and 2,3-hydroxy-1,4-dioxane.

Of these compounds, particularly preferred are dialdehydes such as glutaraldehyde and 2,3-dihydroxy-1,4-dioxane, and boric acid.

The amount of the hardening agents ranges from 0.20 to 3.0 wt. % of the weight of an undercoat, depending on a method of application and a desired hardness. When the amount of addition of a hardening agent is less than 0.20 wt. %, a required hardness is not attained in spite of aging. As a result, the undercoat layer swells when a heat-sensitive layer is formed thereon. By contrast, when the amount of addition exceeds 3.0 wt. %, hardness increases too much. This rather has an adverse effect on bonding between the undercoat layer and a support. The undercoat layer becomes a film-like form and exfoliates from the support. The pH value of a hardening agent may be shifted as needed toward the alkali side through addition of sodium hydroxide or the like or toward the acid side through addition of citric acid or the like.

It is also possible to add a defoaming agent for removing foam which is generated during coating or to add an activator for improving the leveling of a solution to thereby prevent the occurrence of coating streaks. An antistatic agent may be added as needed. Further, it is possible to opaque the undercoat layer through addition of a white pigment.

It is preferred that the surface of a support be activated by a known method before an undercoat layer is formed on the support. Applicable methods of activation include an acid etching treatment, a flame treatment with a gas burner, a corona discharge treatment, and a glow discharge treatment. In view of cost and readiness, the most popular method of activation is a corona discharge treatment as described in U.S. Pat. Nos. 2,715,075, 2,846,727, 3,549,406, and 3,590,107.

A coating solution according to the present invention is applied by a known coating method. Examples of such a coating method include a dip coating method, an air knife coating method, a curtain coating method, a roller coating method, a doctor coating method, a wire bar coating method, a slide coating method, a gravure coating method, and an extrusion coating method using a hopper described in U.S. Pat. No. 2,681,294. Also, two or more layers may be formed simultaneously as needed by those methods described in U.S. Pat. Nos. 2,761,791, 3,508,947, 2,941,898, and 3,526,528, and Yuji HARASAKI, "Coating Engineering" (Asakura Shoten, 1973), p.253. An adequate coating method is selected in accordance with the amount of coating, a coating rate, etc.

A pigment dispersant, a thickener, a fluidity modifying agent, a defoaming agent, a foam inhibitor, a lubricant, and a coloring agent may be added as needed so long as required characteristics are not impaired.

A multi-color heat-sensitive recording material of the present invention is applicable to multi-color sheets for use with facsimile machines and printers connected to computers, which multi-color sheets are required to cope with high-speed recording. In this case, since the multi-color heat-sensitive recording material of the present invention uses diazo compounds as color-generating components, provision of an exposure zone for photodegradation is advantageous in terms of preservation of picture quality and multi-color development.

There are two kinds of layouts of a print head and an exposure zone. One is a single-head multiscan system, and the other is a multihead single-scan system. In the single-head multiscan system, a recording material repeatedly undergoes the following printing cycle. The recording material is once printed at a printing zone, and then is irradiated with light for photodegradation. Before and after this irradiation with light, a feed mechanism brings the recording material to a standby zone where the recording material waits for another printing. The recording material is again fed to the printing zone and undergoes printing at the same position as previously have been printed. By contrast, in the multihead single-scan system, there are as many print heads as colors to be recorded. Each light irradiation zone is placed between print heads. These systems may be combined as needed. A light source for photodegradation may be of any type which generates light having a desired wavelength. Examples of such a light source include fluorescent lamps, xenon lamps, xenon flash lamps, mercury lamps of various pressures, photographic flashes, and stroboscopic lights. In order to make a fixing zone compact, a light source unit and an exposure unit may be separately installed and connected through an optical fiber.

In a multi-color heat-sensitive recording material of the present invention, each heat-sensitive layer generates any hue of Y (yellow), M (magenta), and C (cyan) to thereby reproduce a full-color image as a whole. Preferably, the heat-sensitive layers are arranged in the order of C, Y, and M or C, M, and Y from the side of a support in view of good color reproduction.

EXAMPLES

The present invention will next be described by way of examples, which should not be construed as limiting the invention. Unless otherwise specified, the word "part(s)" means "part(s) by weight."

Example 1

Wood pulp consisting of 50 parts of LBSP and 50 parts of LBKP were refined to Canadian Freeness 300 cc through use of a disk refiner. The following compounds were added.

| | |
|---|---|
| Epoxylated behenic acid amide | 0.5 (part(s)) |
| Anionic polyacrylamide | 1.0 |
| Aluminum sulfate | 1.0 |
| Polyamide polyamine epichlorohydrin | 0.1 |
| Cationic polyacrylamide | 0.5 |

The amount of each ingredient was on an absolute dry weight basis with respect to the weight of the pulp. Base paper having a basis weight of 125 g/m$^2$ was made by use of a NAGATSUNA paper machine. The resultant paper was calendered so as to have a thickness of 110 μm. The interior bonding force of the base paper was 1.9 kgf·cm.

Subsequently, after both surfaces of the base paper were subjected to corona discharge treatment, one surface was coated with high-density polyethylene through use of a melt-extruder, to thereby form a matte-surface resin layer having a thickness of 25 μm (this surface is referred to as a back side). Thereafter, onto the side opposite the side on which the above-mentioned resin layer was formed, low-density polyethylene (m.p. 115° C.) containing 10 wt. % anatase-type titanium dioxide and a trace amount of ultramarine was applied by use of a melt-extruder, to thereby form a 35 μm thick resin layer having a glossy surface (this surface is referred to as a front side).

The polyethylene-coated surface—the back side—was subjected to corona discharge treatment. An antistatic agent was separately prepared by dispersing in water a 1:2 mixture (on a weight basis) of aluminum oxide (Alumina Sol 100, manufactured by Nissan Chemical Industries, Ltd.) and silicon dioxide (Snowtex 0, Nissan Chemical Industries, Ltd.). The resultant antistatic dispersion was applied onto the back side of the paper in an amount of 0.2 g/m$^2$ so as to produce a sheet-like substrate of Example 1.

Example 2

The procedure of Example 1 was repeated except that the thickness of the resin layer on the front side was 60 μm, and that on the back side was 35 μm, to thereby produce a sheet-like substrate of Example 2.

Example 3

The procedure of Example 2 was repeated except that the amount of epoxylated behenic acid amide was 1.0 part, that of anionic polyacrylamide was 0.4 parts, and that of cationic polyacrylamide was 0.2 parts (the amounts of addition are all on an absolute dry weight basis with respect to the weight of pulp), to thereby produce a sheet-like substrate of Example 3. The interior bonding force of the base paper was 1.0 kgf·cm.

Example 4

Wood pulp consisting of 50 parts of LBSP and 50 parts of LBKP were refined to Canadian Freeness 300 cc through use of a disk refiner. The following compounds were added.

| | |
|---|---|
| Epoxylated behenic acid amide | 0.5 (part(s)) |
| Anionic polyacrylamide | 1.0 |
| Aluminum sulfate | 1.0 |
| Polyamide polyamine epichlorohydrin | 0.1 |
| Cationic polyacrylamide | 0.5 |

The amount of each ingredient was on an absolute dry weight basis with respect to the weight of the pulp. Base paper having a basis weight of 110 g/m$^2$ was made by use of a NAGATSUNA paper machine. The resultant paper was calendered so as to have a thickness of 97 μm.

Subsequently, after both surfaces of the base paper were subjected to corona discharge treatment, one surface was coated with high-density polyethylene through use of a melt-extruder, to thereby form a matte-surface resin layer having a thickness of 50 μm (this surface is referred to as a back side). Thereafter, onto the side opposite the side on which the above-mentioned resin layer was formed, low-density polyethylene containing 10 wt. % anatase-type titanium dioxide and a trace amount of ultramarine was applied by use of a melt-extruder, to thereby form a 50 μm thick resin layer having a glossy surface (this surface is referred to as a front side).

The polyethylene-coated surface—the back side—was subjected to corona discharge treatment. An antistatic agent was separately prepared by dispersing in water a 1:2 mixture (on a weight basis) of aluminum oxide (Alumina Sol 100, manufactured by Nissan Chemical Industries, Ltd.) and silicon dioxide (Snowtex 0, Nissan Chemical Industries, Ltd.). The resultant antistatic dispersion was applied onto the back side of the paper in an amount of 0.2 g/m$^2$ so as to produce a sheet-like substrate of Example 4.

Example 5

The procedure of Example 4 was repeated so as to produce a sheet-like substrate of Example 5.

Example 6

The procedure of Example 4 was repeated except that the amount of LBSP was 100 parts, to thereby produce a sheet-like substrate of Example 6.

Example 7

The procedure of Example 4 was repeated except that the basis weight and the thickness of the base paper was 140 g/m$^2$ and 125 μm, respectively, to thereby produce a sheet-like substrate of Example 7.

Example 8

The procedure of Example 4 was repeated except that the basis weight and the thickness of the base paper was 80 g/m$^2$ and 71 μm, respectively, to thereby produce a sheet-like substrate of Example 8.

Example 9

Polyethylene terephthalate film having a thickness of 50 μm was prepared through melt-extrusion and biaxially stretching. This film was used as a plastic film on which multi-color heat-sensitive recording layers were provided.

Subsequently, wood pulp consisting of 50 parts of LBSP and 50 parts of LBKP were refined to Canadian Freeness 300 cc through use of a disk refiner. The following compounds were added.

| | |
|---|---|
| Epoxylated behenic acid amide | 0.5 (part(s)) |
| Anionic polyacrylamide | 1.0 |
| Aluminum sulfate | 1.0 |
| Polyamide polyamine epichlorohydrin | 0.1 |
| Cationic polyacrylamide | 0.5 |

The amount of each ingredient was on an absolute dry weight basis with respect to the weight of the pulp. Base paper having a basis weight of 80 g/m$^2$ was made by use of a NAGATSUNA paper machine. The resultant paper was calendered so as to have a thickness of 71 μm.

Subsequently, one surface of the resultant polyethylene terephthalate film was coated with a two-liquid type adhesive having the below-described formula in an amount of 3 g/m$^2$, dried at 100° C. for 2 minutes, and combined with the aforementioned base paper with heat and pressure (40° C., 20 kg/cm).

| Adhesive: | |
|---|---|
| Polybond AY-651 A (Sanyo Chemical Industries, Ltd.) | 100 (parts) |
| Polybond AY-651 C (Sanyo Chemical Industries, Ltd.) | 15 (parts) |

The surface of the base paper opposite the side on which the above-mentioned plastic film was pressure-bonded was subjected to corona discharge treatment. Subsequently, high-density polyethylene was applied to the corona-discharge-treated surface by use of a melt-extruder, to thereby form a 35 μm thick polyethylene layer having a matte surface. The polyethylene-coated surface—the back side—was subjected to corona discharge treatment. An antistatic agent was separately prepared by dispersing in water a 1:2 mixture (on a weight basis) of aluminum oxide (Alumina Sol 100, manufactured by Nissan Chemical Industries, Ltd.) and silicon dioxide (Snowtex 0, Nissan Chemical Industries, Ltd.). The resultant antistatic dispersion was applied onto the back side of the paper in an amount of 0.2 g/m$^2$ so as to produce a sheet-like substrate of Example 9.

Comparative Example 1

The procedure of Example 1 was repeated except that the base paper was prepared to have a thickness of 115 μm through calender treatment, to thereby produce a sheet-like substrate of Comparative Example 1.

Comparative Example 2

The procedure of Example 1 was repeated except that the resin layer provided on the front side was formed with low-density polyethylene (m.p. 95°), to thereby produce a sheet-like substrate of Comparative Example 2.

The three-dimensional surface roughness on the front surface (prior to color generation of heat-sensitive recording layers) of each of the sheet-like substrates prepared in Examples 1 through 3 and Comparative Examples 1 and 2 is shown in Table 1.

Comparative Example 3

A sheet-like substrate of Comparative Example 3 corresponding to Example 8 was produced.

Comparative Example 4

The procedure of Example 4 was repeated except that the basis weight and the thickness of the base paper was 70 g/m$^2$ and 60 μm, respectively, to thereby produce a sheet-like substrate of Comparative Example 4.

Comparative Example 5

The procedure of Example 4 was repeated except that the basis weight and the thickness of the base paper was 150 g/m$^2$ and 133 μm, respectively, to thereby produce a sheet-like substrate of Comparative Example 4.

The support obtained from each of Examples 1 through 9 and Comparative Examples 1 through 5 was subjected to corona discharge treatment. Thereafter, below-described full-color heat-sensitive recording layers were provided on its corona-discharge-treated surface.

Examples of the preparation of full-color heat-sensitive recording materials are described below.

(1) Preparation of a liquid for forming a cyan heat-sensitive recording layer (Preparation of a capsule-containing liquid containing an electron-donating dye precursor)

1. Liquid A 3-(o-Methyl-p-dimethylaminophenyl)-3-(1'-ethyl-2'-methylindol-3-yl)phthalide (electron-donating dye precursor) was dissolved in ethyl acetate (20 parts). To the solution was added alkyl naphthalene (20 parts, high-boiling point solvent) followed by heating and mixing so as to obtain a uniform mixture.

The resultant mixture was combined with a 1:3 addition product of xylylene diisocyanato and trimethylolpropane and stirred uniformly, to thereby obtain a liquid A.

2. Liquid B

An aqueous solution (2 parts) containing 2% by weight of sodium dodecylsulfonate was added to an aqueous solution (54 parts) containing 6% by weight of phthalic gelatin, to thereby prepare a liquid B.

Liquid A was added to Liquid B, and the resultant mixture was emulsified so as to obtain an emulsion.

Water (68 parts) was added to the emulsion. Mixing operation was performed to obtain a homogeneous mixture. The mixture was heated to 50° C. with stirring, and capsulating reaction was allowed to proceed for 3 hours, so that a capsule-containing liquid containing microcapsules having an average particle size of 1.2 μm was obtained.

(Preparation of a developer emulsion)

1,1-(p-Hydroxyphenyl)-2-ethylhexane (developer, 5 parts), tricresyl phosphate (0.3 parts), and diethyl maleate (0.1 parts) were dissolved in ethyl acetate (10 parts). The resultant solution was added to a solution that had been prepared by mixing 50 g of an aqueous solution containing 6% by weight of gelatin and 2 g of an aqueous solution containing 2% by weight of sodium dodecylsulfonate. The mixture was emulsified for 10 minutes by use of a homogenizer, to thereby obtain an emulsion.

(Preparation of a coating liquid)

The above-prepared capsule-containing liquid containing an electron-donating dye precursor and the developer emulsion were mixed at a proportion by weight of 1:4, to thereby obtain a coating liquid.

(2) Preparation of a liquid for forming a magenta heat-sensitive recording layer (Preparation of a capsule-containing liquid containing a diazo compound)

4-N-(2-(2,4-di-tert-Amylphenoxy)butyryl)piperadinobenzenediazonioum hexafluorophosphate (Diazo compound, decomposed with light at the wavelength of 365 nm, 2.0 parts) was dissolved in ethyl acetate (20 parts). Alkyl naphthalene (20 parts) was added thereto. To the uniform mixture obtained through heating and mixing, a 1:3 addition product (for forming capsular walls, 15 parts) of xylylene diisocyanato and trimethylolpropane was added, the resultant mixture being stirred uniformly, to thereby obtain a solution containing a diazo compound.

The thus-obtained solution containing the diazo compound was added to a solution that had been prepared by mixing 54 parts of an aqueous 6% by weight phthalic gelatin solution and 2 parts of an aqueous 2% by weight sodium dodecylsulfonate solution. The mixture was emulsified by use of a homogenizer.

Water (68 parts) was added to the resultant emulsion. After being mixed uniformly, the mixture was heated to 40° C. with stirring, and capsulating reaction was allowed to proceed for 3 hours, so that a capsule-containing liquid containing microcapsules having an average particle size of 1.2 μm was obtained.

(Preparation of a coupler emulsion)

1-(2'-Octylphenyl)-3-methyl-5-pyrazolone (coupler, 2 parts), 1,2,3-triphenylguanidine (2 parts), tricresylphosphate (0.3 parts), and diethyl maleate (0.1 parts) were dissolved in ethyl acetate (10 parts). The resultant solution was added to an aqueous solution that had been prepared by mixing 50 g of an aqueous 6% by weight gelatin solution and 2 g of an aqueous 2% by weight sodium dodecylsulfonate solution. The mixture was emulsified for 10 minutes by use of a homogenizer.

(Preparation of a coating liquid)

The above-prepared capsule-containing liquid containing a diazo compound and the coupler emulsion were mixed at a proportion by weight of 2:3, to thereby obtain a coating liquid.

(3) Preparation of a liquid for forming a yellow heat-sensitive recording layer (Preparation of a capsule-containing liquid containing a diazo compound)

2,5-Dibutoxy-4-tolylthiobenzenediazonium hexafluorophosphate (Diazo compound, decomposed with light at the wavelength of 420 nm, 3.0 parts) was dissolved in ethyl acetate (20 parts). Alkyl naphthalene (20 parts) was added thereto as a high-boiling point solvent. A mixing operation was performed with the application of heat so as to obtain a uniform mixture.

To the thus-obtained uniform mixture, 15 parts of a 1:3 addition product of xylylene diisocyanato and trimethylolpropane were added, the resultant mixture being stirred uniformly, to thereby obtain a solution containing a diazo compound.

The thus-obtained solution containing the diazo compound was added to a solution that had been prepared by mixing 54 parts of an aqueous 6% by weight phthalic gelatin solution and 2 parts of an aqueous sodium dodecylsulfonate solution. The mixture was emulsified by use of a homogenizer.

Water (68 parts) was added to the resultant emulsion. After being mixed uniformly, the mixture was heated to 40° C. with further stirring, and capsulating reaction was allowed to proceed for 3 hours, so that a capsule-containing solution containing microcapsules having an average particle size of 1.3 $\mu$m was obtained.

(Preparation of a coupler emulsion)

2-Chloro-5-(3-(2,4-di-tert-pentyl)phenoxypropylamino)-acetacetanilide (2 parts), 1,2,3-triphenylguanidine (1 part), tricresylphosphate (0.3 parts), and diethyl maleate (0.1 parts) were dissolved in ethyl acetate (10 parts). The resultant solution was added to an aqueous solution that had been prepared by mixing 50 g of an aqueous 6% by weight gelatin solution and 2 g of an aqueous 2% by weight sodium dodecylsulfonate solution. The mixture was emulsified for 10 minutes by use of a homogenizer.

(Preparation of a coating liquid)

The above-prepared capsule-containing liquid containing a diazo compound and the coupler emulsion were mixed at a proportion by weight of 2:3, to thereby obtain a coating liquid.

(4) Preparation of a liquid for forming an intermediate layer

An aqueous 15% by weight solution (3 parts) of polyacrylic acid (trade name: Jurimer AC-10L, by Nippon Junyaku K.K.) was added to an aqueous 15% by weight solution (10 parts) of gelatin (trade name: #750, by Nitta gelatin K.K.) and mixed uniformly, to thereby obtain a liquid for forming an intermediate layer.

(5) Preparation of a liquid for forming a protective layer

An aqueous 6% by weight solution (100 g) of itaconic acid-modified polyvinyl alcohol (trade name: KL-318, by Kuraray Co., Ltd.) and a dispersion (10 g) containing 30% by weight of epoxy-modified polyamide (trade name: FL-71, by Toho Chemical Industry, Co., Ltd.) were mixed. To the resultant mixture was added 15 g of a dispersion containing 40% by weight of zinc stearate (trade name: Hidrin Z, by Chukyo Yushi K.K.), to thereby obtain a liquid for forming a protective layer.

(6) Preparation of a heat-sensitive recording material

Onto the polymer layer in each of the sheet-like substrates prepared in Examples 1 through 9 and Comparative Examples 1 through 5, the above-described liquids for forming a cyan heat-sensitive recording layer, an intermediate layer, a magenta heat-sensitive recording layer, an intermediate layer, a yellow heat-sensitive recording layer, and a protective layer were applied sequentially in this order through use of a bead coater having a slide-type hopper, in which coating was performed on the slide thereof. The resultant multi-layered product was dried to obtain a multi-color heat-sensitive recording material.

The amounts of coating, reduced to the solid contents after drying, of respective layers were as follows.

Cyan heat-sensitive recording layer: 6.1 g/m$^2$

Intermediate layer: 1.0 g/m$^2$

Magenta heat-sensitive recording layer: 7.8 g/m$^2$

Intermediate layer: 1.0 g/m$^2$

Yellow heat-sensitive recording layer: 7.2 g/m$^2$, and

Protective layer: 2.0 g/m$^2$

As described above, these layers were independently and successively provided on the support in this order.

Subsequently, a cyan image was recorded on each of the multi-color heat-sensitive recording materials obtained from Examples 1 to 3 and Comparative Examples 1 and 2 through use of a thermal head while adjusting the voltage applied and the pulse width so as to obtain a recording energy of 102 mJ/mm$^2$. The uniformity of each recorded image was assessed.

Thereafter, the color-developed heat-sensitive recording layers were removed from the sheet-like substrate by use of pancreatin, and roughness of the surface of the sheet-like substrate on which the heat-sensitive recording layers were provided was determined.

(Assessment of image uniformity)

Uniformity of the resultant images was judged visually. "A" refers to the case in which slightest uneven images were not found at all, indicating remarkably excellent image quality in terms of uniformity. "B" refers to the case in which uneven images were not found, indicating excellent image quality in terms of uniformity. "X" refers to the case in which uneven images were observed, indicating poor image quality in terms of uniformity.

TABLE 1

| | Three-dimensional surface roughness (filter wavelength: 0.8–2.5 mm) | | |
|---|---|---|---|
| Samples | Before color development of heat-sensitive recording layer | After color development of heat-sensitive recording layer | Uniform image quality |
| Example 1 | 0.27 | 0.38 | B |
| Example 2 | 0.19 | 0.32 | A |
| Example 3 | 0.23 | 0.27 | A |
| Comparative Example 1 | 0.32 | 0.46 | X |
| Comparative Example 2 | 0.31 | 0.42 | X |

From Table 1, it is clearly understood that the samples of Examples 1 through 3—in which the roughness of the surface of the sheet-like substrate, the surface being on the side in which heat-sensitive recording layers were provided, was not more than 0.3 μm before the color development of the heat-sensitive recording layers—had a surface roughness of not more than 0.4 μm after the color development of the heat-sensitive recording layers. Thus, the samples of these examples provide excellent images in terms of uniformity.

In contrast, the samples of Comparative Examples 1 and 2—in which the roughness of the surface of the sheet-like substrate, the surface being on the side in which heat-sensitive recording layers were provided, was not more than 0.3 μm before the color development of the heat-sensitive recording layers—had a surface roughness in excess of 0.4 μm after the color development of the heat-sensitive recording layers. Thus, the samples of these Comparative Examples provide images with quality inferior to those of Examples 1 through 3 in terms of uniformity.

By use of each of the samples obtained from Examples 4 to 9 and Comparative Examples 3 to 5, a yellow image was recorded thereon, through use of a thermal head (trade name: Model KST, by Kyocera Corporation) while adjusting the voltage applied and the pulse width so as to obtain a recording energy per area of 34 mJ/mm$^2$.

Subsequently, the yellow heat-sensitive recording layer was exposed to light of a UV lamp (central wavelength of emitted light: 420 nm, power: 40 W) for 10 seconds, to thereby photofix the yellow heat-sensitive recording layer. Thereafter, the recording energy of the thermal head was raised to 68 mJ/mm$^2$ by controlling the voltage applied and the pulse width, a magenta image was recorded.

The magenta heat-sensitive recording layer was exposed to light of a UV lamp (central wavelength of emitted light: 365 nm, power: 40 W) for 15 seconds, to thereby photofix the magenta heat-sensitive recording layer. Thereafter, the recording energy of the thermal head was raised to 102 mJ/mm$^2$ by controlling the voltage applied and the pulse width, a cyan image was recorded.

As describe above, in addition to developed single color images of yellow, magenta, and cyan, four other colors were developed; red in portions in which images of yellow and magenta were overlapped, blue in portions in which images of magenta and cyan were overlapped, green in portions in which images of yellow and cyan were overlapped, and black in portions in which images of yellow, magenta, and cyan were overlapped.

Uniformity of the resultant images was judged visually. "A" refers to the case in which uneven images were not found, indicating excellent image quality in terms of uniformity, and "AA" refers to the case in which slightest uneven images were not found at all, indicating remarkably excellent image quality in terms of uniformity. "X" refers to the case in which uneven images were observed, indicating poor image quality in terms of uniformity.

Regarding the feed performance, overall assessment was made including ease in paper supplying, ease in paper discharging, paper stacking properties, etc., when the heat-sensitive recording materials were actually printed with a printer.

The support rigidity data were obtained in accordance with JIS P8125 in both lengthwise and widthwise directions. The rigidity data in parentheses indicate those corresponding to the printing direction.

The specification of the supports employed are shown in Table 2, and the support rigidity data and the evaluation results of the heat-sensitive recording materials are shown in Table 3.

TABLE 2

| | Resin layer (front side) | | Method for forming the | Base paper | | |
|---|---|---|---|---|---|---|
| Samples | Type | Thickness | resin layer | Basis weight | Thickness | Pulp blends |
| Example 4 | PE | 50 | Melt extrusion | 110 | 97 | LBSP50 LBKP50 |
| Example 5 | PE | 50 | Melt extrusion | 110 | 97 | LBSP50 LBKP50 |
| Example 6 | PE | 50 | Melt extrusion | 110 | 97 | LBSP100 |
| Example 7 | PE | 50 | Melt extrusion | 140 | 125 | LBSP50 LBKP50 |
| Example 8 | PE | 50 | Melt extrusion | 80 | 71 | LBSP50 LBKP50 |
| Example 9 | PET | 50 | Dry lamination | 80 | 71 | LBSP50 LBKP50 |
| Comparative Example 3 | PE | 50 | Melt extrusion | 80 | 71 | LBSP50 LBKP50 |
| Comparative Example 4 | PE | 50 | Melt extrusion | 70 | 60 | LBSP50 LBKP50 |
| Comparative Example 5 | PE | 50 | Melt extrusion | 150 | 133 | LBSP50 LBKP50 |

TABLE 3

| | Rigidity of Support | | Printing | Uniform image | Feed |
|---|---|---|---|---|---|
| Samples | Length | Width | direction | quality | performance |
| Example 4 | 5.2 | (3.6) | Width | AA | A |
| Example 5 | (5.2) | 3.6 | Length | AA | A |
| Example 6 | 4.3 | (2.9) | Width | AA | A |
| Example 7 | 12.0 | (7.8) | Width | A | A |
| Example 8 | (2.5) | 1.8 | Length | AA | A |
| Example 9 | 6.6 | (4.9) | Width | AA | A |
| Comparative Example 3 | 2.5 | (1.8) | Width | AA | B |
| Comparative Example 4 | 1.8 | (1.3) | Width | AA | X |
| Comparative Example 5 | 14.7 | (10.0) | Width | X | A |

As is apparent from Table 3, when the rigidity of the recording material in the printing direction is between 1.5 and 8.0 gf/cm, excellent image uniformity and feed performance are obtained, and in particular, when the rigidity is between 3.0 and 6.0 gf/cm, remarkably exellent image uniformity and feed performance are obtained.

What is claimed is:

1. A multi-color heat-sensitive recording material comprising a support and two or more heat-sensitive recording layers formed on the support, wherein the support is a sheet substrate formed such that a resin layer is formed at least on the side of a base paper where the heat-sensitive recording layers are formed, and the surface of the sheet substrate on the side where the heat-sensitive recording layers are formed has a three-dimensional surface roughness of not more than 0.3 μm as measured at a filter wavelength of 0.8 to 2.5 mm before thermal recording is performed, wherein the resin layer is provided under the recording layers, and the recording layers are superposed one on top of the other.

2. The multi-color heat-sensitive recording material according to claim 1, wherein the surface of the sheet substrate on the side where the heat-sensitive recording layers are formed has a three-dimensional surface roughness of not more than 0.4 μm as measured at a filter wavelength of 0.8 to 2.5 mm after thermal recording is performed.

3. The multi-color heat-sensitive recording material according to claim 2, wherein the sheet substrate is coated with a resin layer on both sides.

4. The multi-color heat-sensitive recording material according to claim 3, wherein the resin layer is made of an olefin resin.

5. The multi-color heat-sensitive recording material according to claim 4, wherein the olefin resin is polyethylene.

6. The multi-color heat-sensitive recording material according to claim 1, wherein the sheet substrate is coated with a resin layer on both sides.

7. The multi-color heat-sensitive recording material according to claim 6, wherein the resin layer is made of an olefin resin.

8. The multi-color heat-sensitive recording material according to claim 7, wherein the olefin resin is polyethylene.

9. A multi-color heat-sensitive recording material comprising a support and two or more heat-sensitive recording layers formed on the support, wherein the support is a sheet substrate formed such that a resin layer is formed on each side of a base paper, and rigidity of the sheet substrate as defined by JIS P8125 is 2.5 to 8.0 gf·cm as measured in a printing direction, wherein the resin layer is provided under the recording layers, and the recording layers are superposed one on top of the other.

10. The multi-color heat-sensitive recording material according to claim 9, wherein the rigidity of the sheet substrate as defined by JIS P8125 is 3.0 to 6.0 gf·cm as measured in a printing direction.

11. The multi-color heat-sensitive recording material according to claim 9, wherein the resin layer is formed by melt extrusion coating.

12. The multi-color heat-sensitive recording material according to claim 9, wherein the resin layer is formed by dry lamination.

13. The multi-color heat-sensitive recording material according to claim 12, wherein the resin layer is made of polyethyleneterephthalate.

14. The multi-color heat-sensitive recording material according to claim 9, wherein the resin layer is made of an olefin resin.

15. The multi-color heat-sensitive recording material according to claim 9, wherein the surface of the sheet substrate on the side where the heat-sensitive recording layers are formed has a three-dimensional surface roughness of not more than 0.5 μm as measured at the center of the surface and at a filter wavelength of 0.8 to 2.5 mm.

16. The multi-color heat-sensitive recording material according to claim 15, wherein the three-dimensional surface roughness is not more than 0.2 μm.

17. A thermal recording method through use of a heat-sensitive recording material, which makes use of a multi-color heat-sensitive recording material comprising a support and two or more heat-sensitive recording layers formed on the support, wherein the support is a sheet substrate formed such that a resin layer is formed on each side of a base paper, and rigidity of the sheet substrate as defined by JIS P8125 is 2.5 to 8.0 gf·cm as measured in a printing direction, wherein the resin layer is provided under the recording layers, and the recording layers are superposed one on top of the other.

* * * * *